United States Patent [19]

Collinson et al.

[11] Patent Number: 4,638,950

[45] Date of Patent: Jan. 27, 1987

[54] APPARATUS FOR APPLYING LIQUID FOR A ROLLING MILL

[75] Inventors: Christopher D. Collinson; Hugh M. Ross, both of Poole, England

[73] Assignee: Davy McKee (Poole) Limited, Dorset, England

[21] Appl. No.: 668,485

[22] Filed: Nov. 5, 1984

[30] Foreign Application Priority Data

Feb. 20, 1984 [GB] United Kingdom ..... 8404387

[51] Int. Cl.[4] ..... B05B 1/14

[52] U.S. Cl. ..... 239/551; 239/569; 251/30.05

[58] Field of Search ..... 239/551, 569–571, 239/585, 562; 251/30.01, 30.02, 30.05

[56] References Cited

U.S. PATENT DOCUMENTS 3,145,967 8/1964 Gardner ..... 251/30.05 X
3,570,725 3/1971 Baker et al. ..... 239/551 X
3,684,177 8/1972 Barlow ..... 239/551 X
4,230,270 10/1980 Poret ..... 239/562 X
4,387,739 6/1983 Schaming ..... 239/551 X
4,568,026 2/1986 Baun ..... 239/551

*Primary Examiner*—Joseph F. Peters, Jr.
*Assistant Examiner*—Daniel R. Edelbrock
*Attorney, Agent, or Firm*—Lee, Smith & Zickert

[57] ABSTRACT

An apparatus for applying liquid to mill rolls has a bar with two longitudinally extending manifolds. Into the bar are inserted spray nozzles and associated diaphgragm valve structures. One of the manifolds is for the supply of coolant and/or lubricating fluid to the nozzles via the valves. The other manifold has a control fluid (air) under pressure which is used to operate the diaphragm valves to connect or disconnect the supply of coolant/lubricant. To control the control fluid each diaphragm valve unit has a solenoid operated valve for selectively connecting the air at pressure in the second manifold to the diaphragm valve.

6 Claims, 3 Drawing Figures

APPARATUS FOR APPLYING LIQUID FOR A ROLLING MILL

BACKGROUND OF THE INVENTION

This invention relates to means for applying liquid, e.g. coolant or lubricant, and in particular, although not exclusively to a spray unit for a rolling mill for supplying lubricating and/or cooling fluid to the mill rolls or to material being rolled therein.

A spray unit for a rolling mill, described in our European patent application No. 0041863, includes a spray bar, to be mounted adjacent the mill rolls, having a manifold for liquid to be sprayed and series of spray nozzles or sets of spray nozzles spaced along the spray bar. Each nozzle or set of nozzles communicates with the manifold via a conduit, and a diaphragm of a diaphragm type valve is arranged to close the end of the conduit projecting into the manifold and thereby regulate the supply of liquid, under the control of diaphragm control means. One type of diaphragm control means described in the application uses pressurised air to force the diaphragm into an obturation position. A compartment is provided adjacent each diaphragm-valve with the diaphragm defining one wall of the compartment, and the pressurised air is provided to each of the compartments to move the diaphragm to close off the end of the respective conduit. The other type of diaphragm control means described is a solenoid which is arranged so that a moveable core can engage the diaphragm to move the diaphragm to the obturation position.

While the solenoid operated diaphragm-valves can have a quicker response time than the pressure operated diaphragm-valves, and are susceptible of electronic control, the repeated engagement of the solenoid core with the diaphragm can cause undesirable wear, with a reduced working-life compared to the pressure operated diaphragm-valves. The present invention seeks to provide a spray unit for a rolling mill, which overcomes disadvantges of the described spray unit.

It is an object of the present invention to provide an improved apparatus for applying liquid for a rolling mill.

It is a further object of the invention to provide an apparatus for applying coolant to a rolling mill which is of simply and readily serviceable construction.

SUMMARY OF THE INVENTION

According to a first aspect the invention provides an apparatus for applying liquid for cooling and/or lubricating a rolling mill having mill rolls, comprising:

(a) a bar for mounting adjacent the mill rolls,
(b) a manifold in the bar for liquid to be sprayed,
(c) a series of valve units carried by, and spaced along the bar,
(d) for each valve unit, a liquid delivery conduit communicating with the manifold,
(e) for each valve unit a flexible diaphragm moveable to close with one side the respective conduit,
(f) a source of control fluid under pressure,
(g) for each diaphragm, a solenoid operated fluid valve arranged to control the flow of the control fluid between the source of the fluid under pressure and the other side of the diaphragm whereby the diaphragm will be moved to close the conduit,
(h) a second manifold in the bar, for the supply of control fluid under pressure, and the solenoid operated valve being arranged to control the flow of fluid between the second manifold and the space on the said other side of the diaphragm.

The apparatus for applying liquid of the invention may be used with various applicator means which would be mounted on the bar or each valve unit, and be operatively connected to the liquid delivery conduit of a respective valve unit. In the embodimentt of the present invention the applicator means are spray nozzles as described hereinafter and the apparatus for applying liquid can then be termed a spray unit.

Thus, according to another aspect the invention provides a spray unit for a rolling mill, comprising: a spray bar which is adapted to be mounted adjacent the mill rolls and which has a manifold for liquid to be sprayed; a series of spray nozzles or sets of spray nozzles carried by, and spaced along the bar and each nozzle or set being connected to a conduit communicating with the manifold; for each nozzle or set of nozzles a flexible diaphragm moveable to close with one side the conduit, and for each diaphragm a solenoid operated fluid valve; and the spray bar having a second manifold for a supply of fluid under pressure; and the solenoid operated valve being arranged to control the flow of a fluid between the second manifold, and a space on the other side of the diaphragm, whereby the diaphragm will be moved to close the conduit.

DESCRIPTION OF PREFERRED EMBODIMENTS

Figure 1:
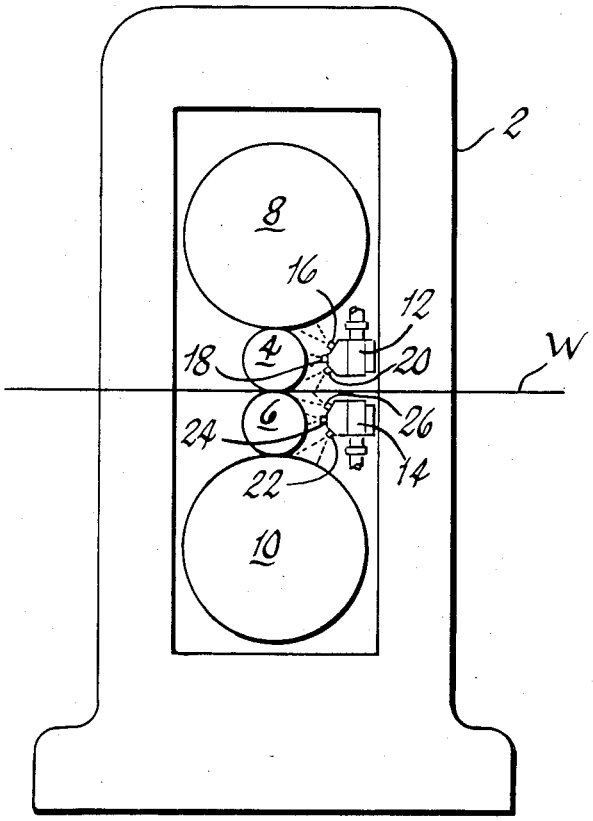
FIG. 1 shows diagrammatically a side elevation of a rolling mill provided with the spray unit.

As seen in FIG. 1 a rolling mill 2 has two roll assemblies, exemplified by work roll 4 and back-up roll 8, and work roll 6 and back-up roll 10. A workpiece W is shown as being rolled between the two assemblies. For the purpose of supplying rolling coolant/lubricant in the form of a fluid to the rolls and the workpiece, the mill is provided with spray bars 12, 14 arranged adjacent the mill and parallel to the roll axes. The spray bar 12 has spaced along its length sets of nozzles, each set comprising a jet nozzle 16 for directing fluid to the top back-up roll, a nozzle 18 for directing fluid to the top work roll and a nozzle 20 for directing fluid to the upper side of the workpiece.

Spray bar 14 is similar, having nozzles 22, 24 and 26 for directing fluid to the bottom back-up roll, the bottom work roll and the underside of the workpiece respectively.

Figure 2:
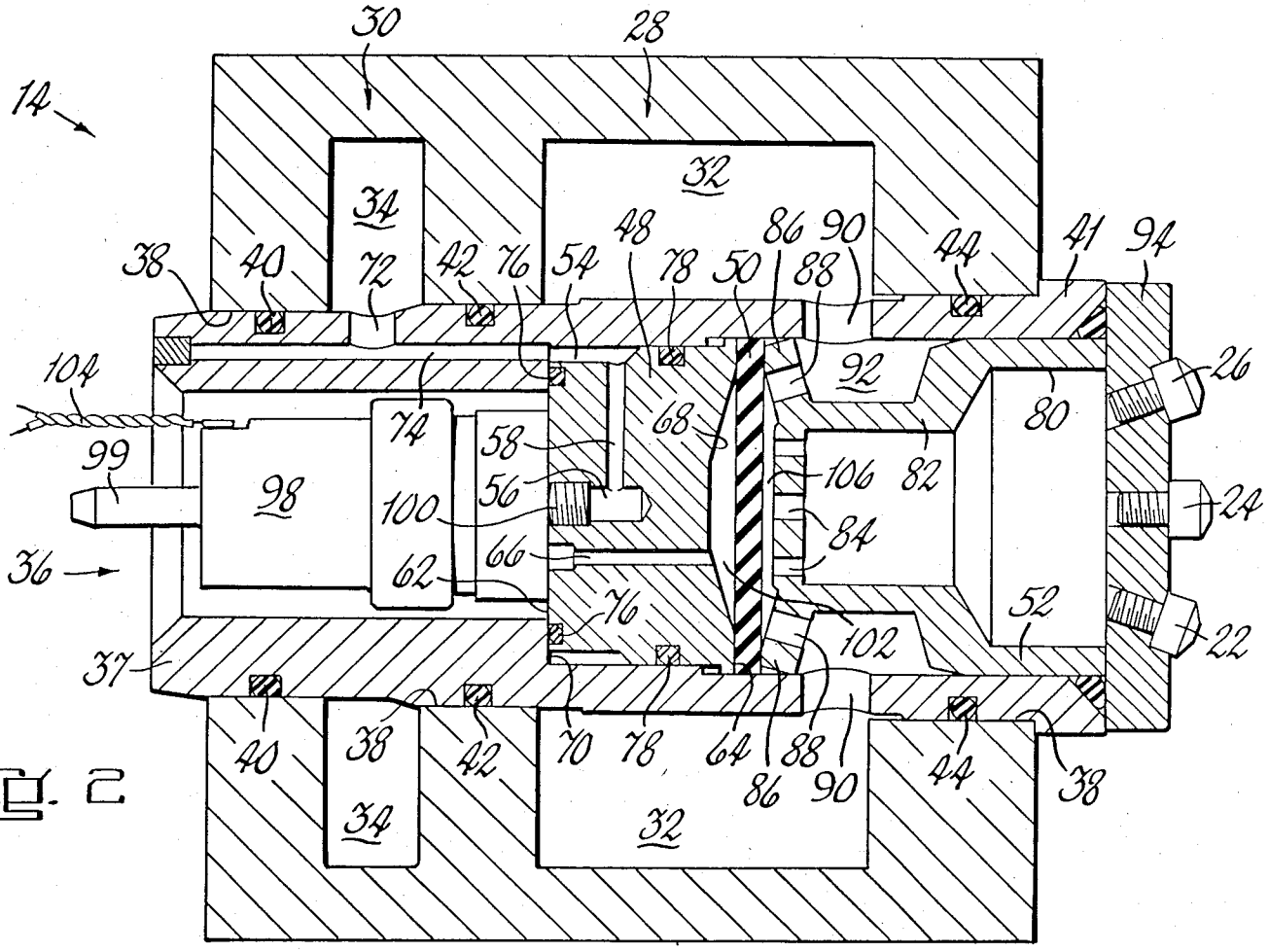
FIG. 2 is a section through a spray bar of the spray unit.

Dealing now with details of each spray unit reference is made to FIG. 2 which shows a section through the spray bar 14, it being understood that the bar 12 is similar in most respects.

Spray bar 14 has parallel first and second manifolds 28 and 30 with chambers 32 and 34 extending the entire length of the spray bar. Manifold 28 is supplied with liquid coolant (water or a water/oil emulsion) while manifold 30 is supplied with air under pressure. At intervals along its length, the spray bar has aligned bores 38 which open to the chambers 32 and 34. A valve unit 36 which includes an external sleeve 37, is receivable in the bores 38 and crosses the chambers 32 and 34.

Sleeve 37 has a flange 41 at one end to locate the valve unit axially with respect to the spray bar. The valve unit 36 has a valve block 48, a valve body 52 and a diaphragm 50 anchored peripherally between valve block 48 and the valve body 52 which together fit within sleeve 37.

The valve block 48 is generally cylindrical with an annular recess 54 adjacent one end face 62, which is connected by a radial bore 58 to an axial, blind hole 56 in that end face 62. A shallow conical depression 68 in the other end face 64 is connected by an axially parallel bore 66 to the first end face 62. The block 48 fits within the sleeve 37 with the first end face 62 abutting an internal shoulder 70 of the sleeve 37. The sleeve 37 has a short radial hole 72 which communicates with the chamber 34 of second manifold 30, and an axially parallel bore 74 in the sleeve 37 connects the radial hole 72 to the surface of the shoulder 70, adjacent the annular recess 54 in the valve block 48. Thus, the chamber 34 communicates with the annular recess 54 in the valve block 48 and thereby with the axial blind hole 56. The valve block 48 has an annular seal 76 in the end face 62, which engages the shoulder 70 of the sleeve, and an annular seal 78 which engages with the main internal wall of the sleeve 37.

The valve body 52 is generally cylindrical with a main portion 80 of external diameter substantially equal to the internal diameter of the sleeve 37, and an extension 82 of reduced diameter. The end of the cylindrical extension 82 is closed and has through holes 84. An annular flange 86 projects radially from the end of cylindrical extension 82, and has through holes 88. The flange 86 has shallow conical form and slopes away from the remainder of the valve body 52 to abut the diaphragm 50, thereby providing a shallow valve cavity 106 between the diaphragm 50 and the closed end of the cylindrical extension 82. The region about the cylindrical extension 82 between the flange 86 and the main cylinder 80 of the valve body, forms an annular cavity 92. A series of radial through holes 90 in the sleeve 37 communicate the chamber 32 of manifold 28 with the annular cavity 92 about the extension 82.

The diaphragm 50, conveniently made from a flexible polyurethane material, is peripherally held securely between the valve block 48 and valve body 52. The diaphragm 58 is a close fit within sleeve 37 thereby providing a liquid tight seal between the valve block and the valve body. The diaphragm 50 closes the depression 68 in the end face of the valve block 48, except for the bore 66, to define a diaphragm chamber 102. The valve block 48 and body 52 are held in place by an end cap 94 in which are secured the set of spray nozzles 22, 24, 26. The spray nozzles 22, 24, 26 communicates with the inside of valve body 52 via conduits 21, 23 and 25 respectively.

A solenoid operated air valve 98 of known construction e.g. clippard type evo-3m is mounted on the valve block 48 by a threaded, bored spigot 100 which is a screw fit in the blind hole 56. The solenoid valve is fitted so that an outlet port of the valve coincides with opening of the bore 66 to the diaphragm chamber 102, and a vent in the valve is connected via a pipe 99 to the atmosphere. The solenoid valve is connected to an electrical supply by control leads 104.

In use the valve 46 operates as follows. Manifold 28 is connected to a supply of coolant/lubricant and manifold 30 to a supply of pressurised air. Air under pressure in manifold 30 passes from cavity 34 through the radial hole 72, and the bore 74 into the annular recess 54 of the valve block 48 and thence, via bore 58 and blind hole 56 to hollow spigot 100 and the input side of solenoid valve 98. The solenoid valve 98 controls the flow of the air under pressure to diaphragm chamber 102 via bore 66. When no pressurised air is supplied to diaphragm chamber 102, coolant/lubricant in the manifold 28 passes from chamber 32, through radial holes 90 into the annular cavity 92, through the holes 88 in the annular flange 86 into the valve cavity 106 into the valve body 52 through holes 84 and out through the spray nozzles. When the solenoid valve is operated to supply air to the diaphragm chamber 102 the pressure of air flexes the diaphragm 50 into engagement with the end of the valve body 52 thereby closing the holes 84 in the end of the valve body and the holes 88 in the annular flange 86, and cutting off the supply of coolant/lubricant fluid to the spray nozzles.

When the solenoid valve 98 is closed to cut off the supply of air to the diaphragm chamber 102, a vent in the solenoid valve opens to bleed the air pressure in the diaphragm chamber 102, that air being exhausted through the pipe 99 to the atmosphere.

It will be appreciated that the diaphragm 50 need not close both the holes 84 in the valve body and the holes 88 in the annular flange 86, but closure of both sets of holes is preferable.

In operation the valve unit 36 has only two moving parts—the solenoid air valve 98 and the diaphragm 50—which makes the unit durable and reliable. Furthermore, if servicing is required, identification of a potential fault is made relatively simply and servicing is facilitated by the whole valve unit 36 being removable from one side of the spray bar, after control leads 104 have been disconnected. Similarly replacement of a valve unit can be effected from one side of the spray bar, and by provision of similar spare valve units, the "down time" of the spray unit can be reduced, while a particular valve unit is being serviced.

A particular advantage of the spray unit of the preferred embodiment is the absence of a multiplicity of air lines which were present in previous spray units where each valve had a separate air line. The valve unit described has a separate set of control leads 104, but a single set of control leads may be provided with each solenoid air valve being adapted to respond to a particular control signal. Alternatively, a group of valve units may be adapted to respond to a particular control signal. Such an arrangement may be computer controlled to take advantage of the use of the electrically operated solenoid valves.

Figure 3:
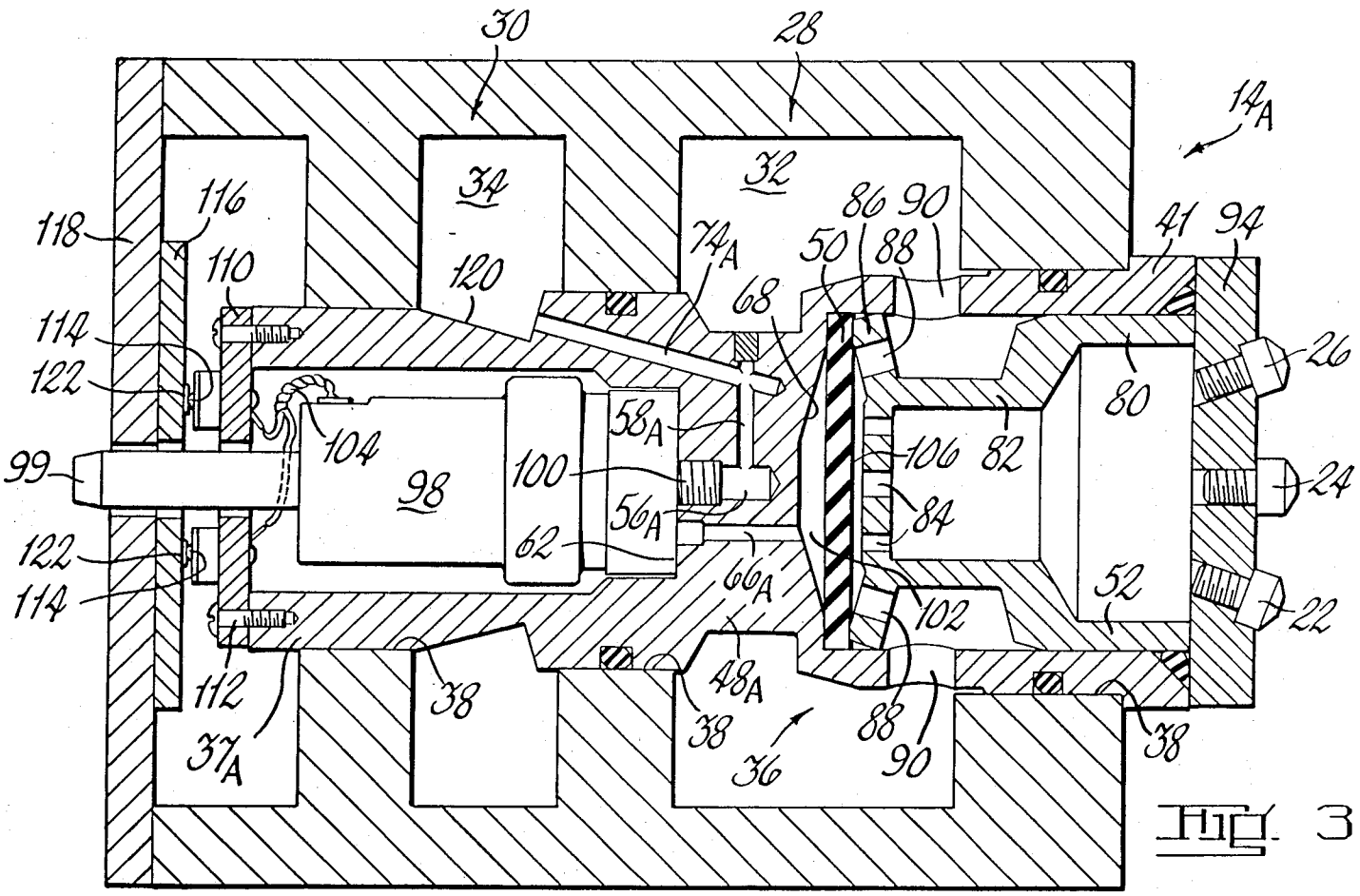
FIG. 3 is a section through a spray bar of another embodiment.

An alternative embodiment is shown in FIG. 3 where, apart from the features referred to below, the spray bar and operative components are identical to those shown in FIG. 2, and similar reference numerals have been used for like parts. In the FIG. 3 embodiment a valve block 48A is formed in one with a sleeve 37A. In this embodiment the sleeve 37A is formed with an annular groove 120 which communicates via bores 74A and 58A with a blind hole 56A and spigot 100. A bore 66A connects the diaphragm chamber 102 with the solenoid valve 98. A cover plate 110, fixed by screws 112 to the end face of the sleeve 37A, carries spring contacts 114 to which the control leads 104 are connected. A printed circuit board 116 is carried by a cover plate 118 which is attached to the spray bar 14A. The printed circuit board 116 carries a circuit with metal control lines 122 for connection to the solenoid 98.

Upon assembly of the sleeve 37A within the spray bar the contacts 114 engage with the appropriate metal control lines 122 of the circuit.

What we claim is:

1. An apparatus for applying liquid for cooling and/or lubricating in a rolling mill comprising:

an elongate bar having a first manifold extending in the direction of its length and connected to a supply of liquid to be applied;

a multiplicity of spray units having associated spray nozzles, each spray unit being supported by the bar and each spray unit having a fluid connection with the first manifold;

each fluid connection having a valve associated therewith whereby the supply of liquid to the spray units can be controlled;

each valve having a diaphragm capable of closing with a first side the fluid connection between the first manifold and the spray unit;

said elongate bar having a second manifold extending in the direction of the length of the bar, and a source of control fluid under pressure connected to the second manifold;

for each valve, a second fluid connection between the second manifold and the other side of the diaphragm in the valve; and each of said second connections having a respective solenoid operated fluid valve therein to control the flow of control fluid from the second manifold, through said second connection to said other side of the diaphragm of the valve.

2. An apparatus as claimed in claim 1 wherein each spray unit is removable in one piece from the elongate bar.

3. An apparatus as claimed in claim 2 wherein the bar has a cover plate carrying electrical connection for the solenoid operated valve, and each solenoid valve has metal contacts which engage with the connections in the cover plate.

4. An apparatus as claimed in claim 2, wherein the solenoid operated valve associated with each spray unit is secured to the spray unit and is removable therewith from the elongate bar.

5. An apparatus as claimed in claim 4 wherein the bar has a cover plate carrying electrical connection for the solenoid operated valve, and each solenoid valve has metal contacts which engage with the connections in the cover plate.

6. An apparatus as claimed in claim 1 wherein the bar has a cover plate carrying electrical connection for the solenoid operated valve, and each solenoid valve has metal contacts which engage with the connections in the cover plate.

* * * * *